US008549878B2

(12) United States Patent
Yoshino et al.

(10) Patent No.: US 8,549,878 B2
(45) Date of Patent: Oct. 8, 2013

(54) METHOD OF GENERATING NITROGEN AND APPARATUS FOR USE IN THE SAME

(75) Inventors: Akira Yoshino, Osaka (JP); Koji Tanaka, Osakasayama (JP); Ryosuke Matsubayashi, Sakai (JP); Junya Suenaga, Sakai (JP); Shinya Okumura, Sakai (JP)

(73) Assignee: Air Water Inc., Sapporo-shi, Hokkaido (JP)

( * ) Notice: Subject to any disclaimer, the term of this patent is extended or adjusted under 35 U.S.C. 154(b) by 1094 days.

(21) Appl. No.: 11/993,907

(22) PCT Filed: Jun. 16, 2006

(86) PCT No.: PCT/JP2006/312103

§ 371 (c)(1),
(2), (4) Date: Dec. 26, 2007

(87) PCT Pub. No.: WO2006/137331

PCT Pub. Date: Dec. 28, 2006

(65) Prior Publication Data

US 2009/0223247 A1 Sep. 10, 2009

(30) Foreign Application Priority Data

Jun. 23, 2005 (JP) ..... 2005-183898

(51) Int. Cl.
*F25J 3/00* (2006.01)

(52) U.S. Cl.
USPC ..... 62/644; 62/643; 62/648; 62/650; 62/656

(58) Field of Classification Search
USPC ..... 62/643, 644, 646, 650
See application file for complete search history.

(56) References Cited

U.S. PATENT DOCUMENTS 4,222,756 A 9/1980 Thorogood
4,464,188 A * 8/1984 Agrawal et al. ..... 62/646

(Continued)

FOREIGN PATENT DOCUMENTS

DE 3528374 A1 2/1987
EP 0605262 A1 7/1994

(Continued)

OTHER PUBLICATIONS

International Search Report of PCT/JP2006/312103, date of mailing Jul. 18, 2006.

(Continued)

*Primary Examiner* — Frantz Jules
*Assistant Examiner* — Keith Raymond
(74) *Attorney, Agent, or Firm* — Westerman, Hattori, Daniels & Adrian, LLP

(57) ABSTRACT

There is provided a method of generating nitrogen which includes cryogenically separating compressed air introduced into a high-pressure column 11, storing liquid air 13 in a bottom portion of the high-pressure column 11 and taking nitrogen in gaseous form from an upper portion of the high-pressure column 11, introducing the liquid air 13 stored in the bottom portion of the high-pressure column 11 into a low-pressure column 12, cryogenically separating the liquid air 13 introduced into the low-pressure column 12 and storing oxygen-enriched liquid air 22 in a bottom portion of the low-pressure column 12 and taking nitrogen in gaseous form from an upper portion of the low-pressure column 12 as a product gas. Liquid air 13 taken through an extraction pipe 20 is introduced into a portion of a rectification part 12*a* of the low-pressure column 12 in which the number of theoretical plates from a column bottom side is set within the range of one to ten.

3 Claims, 3 Drawing Sheets

(56) References Cited

U.S. PATENT DOCUMENTS

| | | | | |
|---|---|---|---|---|
| 4,671,813 | A * | 6/1987 | Yoshino | 62/643 |
| 5,408,831 | A * | 4/1995 | Guillard et al. | 62/647 |
| 5,678,427 | A * | 10/1997 | Bonaquist et al. | 62/650 |
| 6,185,960 | B1 * | 2/2001 | Voit | 62/656 |
| 6,357,259 | B1 * | 3/2002 | Higginbotham et al. | 62/656 |
| 6,708,523 | B2 * | 3/2004 | Lochner et al. | 62/643 |
| 2006/0272352 | A1 * | 12/2006 | Aoki et al. | 62/644 |

FOREIGN PATENT DOCUMENTS

| | | | |
|---|---|---|---|
| EP | 1300640 | A1 | 4/2003 |
| JP | 33009870 | B1 | 11/1958 |
| JP | 021013173 | A | 4/1990 |
| JP | 03158693 | A | 7/1991 |
| JP | 3-230080 | A | 10/1991 |
| JP | 04208384 | A | 7/1992 |
| JP | 5-240579 | A | 9/1993 |
| JP | 06229668 | A | 8/1994 |
| JP | 06341760 | A | 12/1994 |
| JP | 07198253 | A | 8/1995 |
| JP | 8-296961 | A | 11/1996 |
| JP | 10206009 | A | 8/1998 |
| JP | 11101576 | A | 4/1999 |
| JP | 2003148864 | A | 5/2003 |
| JP | 2005009755 | A | 1/2005 |
| WO | 2004/085941 | A1 | 10/2004 |

OTHER PUBLICATIONS

English translation of the International Preliminary Report on Patentability issued in PCT/JP 2006/312103 (Forms PCT/IB/373 and PCT/ISA/237).

European Search Report dated Jan. 18, 2011, issued in corresponding European Patent Application No. 06766791.5.

Chinese Office Action, issued May 17, 2010 for corresponding Chinese Patent Application No. 2006-80021516.8.

Chinese Office Action dated Feb. 20, 2009, issued in corresponding Chinese Patent Application No. 2006800215168.

* cited by examiner

METHOD OF GENERATING NITROGEN AND APPARATUS FOR USE IN THE SAME

TECHNICAL FIELD

The present invention relates to a method of generating nitrogen and an apparatus for use in the same.

BACKGROUND ART

An example of coolant injection type nitrogen generating apparatuses currently in use is of a single rectification type, as shown in FIG. 3. This nitrogen generating apparatus performs the steps of: compressing air as a raw material in an air compressor 31; passing the compressed air through a drain separator 32 and a CFC cooler 33 into adsorption columns 34 to remove carbon dioxide and water from the compressed air; introducing the compressed air passed through the adsorption columns 34 through a supply pipe 35 into a main heat exchanger 36 to heat-exchange the compressed air with a refrigerant therein, thereby cooling the compressed air down to an ultra low temperature; introducing the compressed air cooled down to the ultra low temperature through an inlet pipe 37 into a rectification column 38 to cryogenically liquefy and separate the compressed air therein, thereby producing a product nitrogen gas; introducing the product nitrogen gas through a product nitrogen gas extraction pipe 39 into the above-mentioned main heat exchanger 36 to raise the temperature of the product nitrogen gas up to near room temperature; and feeding the product nitrogen gas into a main pipe 40. The above-mentioned rectification column 38 will be described in further detail. The rectification column 38 further cools the compressed air, cooled down to the ultra low temperature by the main heat exchanger 36, to liquefy part of the compressed air into liquid air 41, thereby storing the liquid air 41 in a bottom portion thereof, while storing only nitrogen in gaseous form in an upper portion thereof. The rectification column 38 includes a dephlegmator 42 incorporating a condenser 42*a* at its column top. Part of the nitrogen gas stored in the upper portion of the rectification column 38 is fed through a first reflux pipe 43*a* into the above-mentioned condenser 42*a*. The pressure in the above-mentioned dephlegmator 42 is lower than that in the rectification column 38. The stored liquid air (containing 50 to 70% $N_2$; and 30 to 50% $O_2$) 41 accumulated in the bottom portion of the rectification column 38 is fed through a feed pipe 44 with an expansion valve 44*a* into the dephlegmator 42, and is gasified to cool the internal temperature down to a temperature not greater than the boiling point of liquid nitrogen. This cooling liquefies the nitrogen gas fed into the condenser 42*a*, and the liquid nitrogen passes through a second reflux pipe 43*b* to flow down and be supplied to the upper portion of the rectification column 38. Liquid nitrogen is injected and supplied as a coolant from a liquid nitrogen tank (not shown) through an inlet pipe 45 into the upper portion of the rectification column 38. The liquid nitrogen flows down within the rectification column 38 to countercurrently contact and cool the compressed air raising from the bottom portion of the rectification column 38, thereby liquefying part of the compressed air. In this course, a high boiling point component in the compressed air is liquefied and stored in the bottom portion of the rectification column 38, and the nitrogen gas which is a low boiling point component is stored in the upper portion of the rectification column 38 (the boiling point of oxygen: approximately −183° C.; and the boiling point of nitrogen: approximately −196° C.). In FIG. 3, the reference numeral 46 designates a waste gas outlet pipe for feeding gasified liquid air (waste gas) within the dephlegmator 42 into the heat exchanger 36 to decrease the temperature of the compressed air passing therethrough, 47 designates a first release pipe for releasing the gasified liquid air passed through the heat exchanger 36 into the atmosphere, 48 designates a second release pipe for releasing a He gas in gaseous form (having a boiling point lower than that of the nitrogen gas) contained in the nitrogen gas into the atmosphere, and 49 designates a cold box for vacuum insulating the interior thereof.

Patent document 1: Japanese Patent Application Laid-Open No. 11-101576 (1999)

DISCLOSURE OF THE INVENTION

Problems to be Solved by Invention

Improvements have been made heretofore in the nitrogen generating apparatuses employing the single rectification scheme as described above for reducing the amount of raw material air in order to reduce gas production costs. However, the current A/N (the amount of raw material air/the amount of produced nitrogen) ratio approximately equal to 2.1 is already close to the limit, and it is difficult to further reduce the amount of raw material air to accomplish reductions in power consumption, the amount of coolant and costs of facilities.

In view of the foregoing, it is an object of the present invention to provide a method of generating nitrogen which is capable of significantly reducing the amount of raw material air to accomplish the reductions in power consumption, the amount of coolant and costs of facilities, and an apparatus for use in the same.

Means for Solving Problems

To accomplish the above object, a first aspect of the present invention is intended for a method of generating nitrogen which comprises: compressing air taken from outside by using an air compression means; cooling the compressed air down to a low temperature in a main heat exchanger and then introducing the compressed air into a high-pressure column; cryogenically separating the compressed air introduced into the high-pressure column by using a difference in boiling point between components in the compressed air; storing liquid air in a bottom portion of the high-pressure column and taking nitrogen in gaseous form for use as a reflux liquid from an upper portion of the high-pressure column; introducing the liquid air stored in the bottom portion of the high-pressure column through a liquid air extraction passage into a low-pressure column; cryogenically separating the liquid air introduced into the low-pressure column by using a difference in boiling point between components in the liquid air; storing oxygen-enriched liquid air in a bottom portion of the low-pressure column and taking nitrogen in gaseous form from an upper portion of the low-pressure column to introduce the nitrogen as a product gas into a product gas extraction passage; introducing the nitrogen in gaseous form extracted for use as the reflux liquid from the upper portion of the high-pressure column into a condenser to liquefy the nitrogen; refluxing part of the liquid nitrogen as the reflux liquid to the high-pressure column and feeding the remainder of the liquid nitrogen to the upper portion of the low-pressure column; and introducing liquid nitrogen or liquid oxygen from outside a system into the low-pressure column as a coolant for supplementing heat loss in the heat exchanger or heat entering from outside, wherein the liquid air taken through the liquid air extraction passage is introduced into a portion of a rectification part of the low-pressure column in which the number of theoretical plates from a column bottom side is set within the range of one to ten. A second aspect of the present invention is intended for an apparatus for generating nitrogen which comprises: an air compression means for compressing air taken from outside; a main heat exchanger for cooling the compressed air compressed by the air compression means down to a low temperature; a high-pressure column for cryogenically separating the compressed air cooled down to the low temperature through the main heat exchanger by using a difference in boiling point between components in the compressed air to store liquid air in a bottom portion of the high-pressure column and to take nitrogen in gaseous form for use as a reflux liquid from an upper portion of the high-pressure column; a low-pressure column receiving the liquid air taken from the bottom portion of the high-pressure column through a liquid air extraction passage and for cryogenically separating the liquid air by using a difference in boiling point between components in the liquid air to store oxygen-enriched liquid air in a bottom portion of the low-pressure column and to take nitrogen in gaseous form from an upper portion of the low-pressure column; a product gas extraction passage for receiving the nitrogen taken in gaseous form from the upper portion of the low-pressure column as a product gas; a condenser receiving the nitrogen in gaseous form extracted for use as the reflux liquid from the upper portion of the high-pressure column and for liquefying the nitrogen; a reflux passage for refluxing part of the liquid nitrogen taken from the condenser as the reflux liquid to the high-pressure column; a feed passage for feeding the remainder of the liquid nitrogen taken from the condenser to the upper portion of the low-pressure column; and an inlet passage for introducing liquid nitrogen or liquid oxygen from outside a system into the low-pressure column as a coolant for supplementing heat loss in the heat exchanger or heat entering from outside, wherein the liquid air taken through the liquid air extraction passage is introduced into a portion of a rectification part of the low-pressure column in which the number of theoretical plates from a column bottom side is set within the range of one to ten.

Effects of the Invention

In the course of studies for obtaining a nitrogen generating method which is capable of significantly reducing the amount of raw material air to accomplish significant reductions in power consumption, the amount of coolant and costs of facilities, and an apparatus for use in the same, the present inventors have focused attention on the fact that the process of feeding the liquid air stored in the bottom portion of the high-pressure column into the low-pressure column to cryogenically separate the liquid air again enables the low-pressure column to extract the nitrogen component in the above-mentioned liquid air, thereby achieving an improvement in the yield of the high purity nitrogen gas, when the following steps are executed: compressing air taken from outside by using the air compression means, cooling the compressed air down to a low temperature in the main heat exchanger and then introducing the compressed air into the high-pressure column, cryogenically separating the compressed air introduced into the high-pressure column by using a difference in boiling point between components in the compressed air, storing liquid air in the bottom portion of the high-pressure column and taking nitrogen in gaseous form for use as a reflux liquid from the upper portion of the high-pressure column, introducing the liquid air stored in the bottom portion of the high-pressure column through the liquid air extraction passage into the low-pressure column, cryogenically separating the liquid air introduced into the low-pressure column by using a difference in boiling point between components in the liquid air, storing oxygen-enriched liquid air in the bottom portion of the low-pressure column and taking nitrogen in gaseous form from the upper portion of the low-pressure column to introduce the nitrogen as a product gas to a product gas extraction passage, introducing the nitrogen in gaseous form extracted for use as the reflux liquid from the upper portion of the high-pressure column into the condenser to liquefy the nitrogen, refluxing part of the liquid nitrogen as the reflux liquid to the high-pressure column and feeding the remainder of the liquid nitrogen to the upper portion of the low-pressure column, and introducing liquid nitrogen or liquid oxygen from outside a system into the low-pressure column as a coolant for supplementing heat loss in the heat exchanger or heat entering from outside. Thus, the present inventors have made a series of studies. As a result, the present inventors have attained the present invention by finding the fact that the introduction of the liquid air taken through the liquid air extraction passage into a portion of the rectification part of the low-pressure column in which the number of theoretical plates from a column bottom side is set within the range of one to ten provides a significant improvement in the yield of the high purity nitrogen gas to significantly reduce the amount of raw material air, thereby accomplishing the significant reductions in power consumption, the amount of coolant and costs of facilities (that is, accomplishing the significant reductions in power consumption and the costs of facilities by reducing the size of the facilities related to raw material air, and accomplishing the significant reduction in the amount of coolant by significantly reducing the amount of coolant [the amount of injection of the liquid nitrogen] which supplements the heat loss in the main heat exchanger and by utilizing the cooling energy of the liquid nitrogen injected into the low-pressure column even in a low-pressure region) In the present invention, an example of a rectification means for use in the rectification part of the low-pressure column may include a structure known as rectification trays or packings (a structured packing, a random packing and the like).

In the present invention, when an inlet of the inlet passage is provided in a lower portion of the rectification part of the low-pressure column, liquid nitrogen or liquid oxygen may be introduced as a coolant into a lower space of the rectification part of the above-mentioned low-pressure column.

In the present invention, when an exhaust gas outlet for introducing an exhaust gas in a lower portion of the low-pressure column to outside is provided in a lower portion of the rectification part of the low-pressure column, the gas stored in the lower portion of the above-mentioned low-pressure column and containing less high purity nitrogen gas can be introduced as the exhaust gas to the outside. This further improves the yield of the high purity nitrogen gas extracted from the upper portion of the above-mentioned low-pressure column.

DESCRIPTION OF REFERENCE NUMERALS AND CHARACTERS

Figure 1:
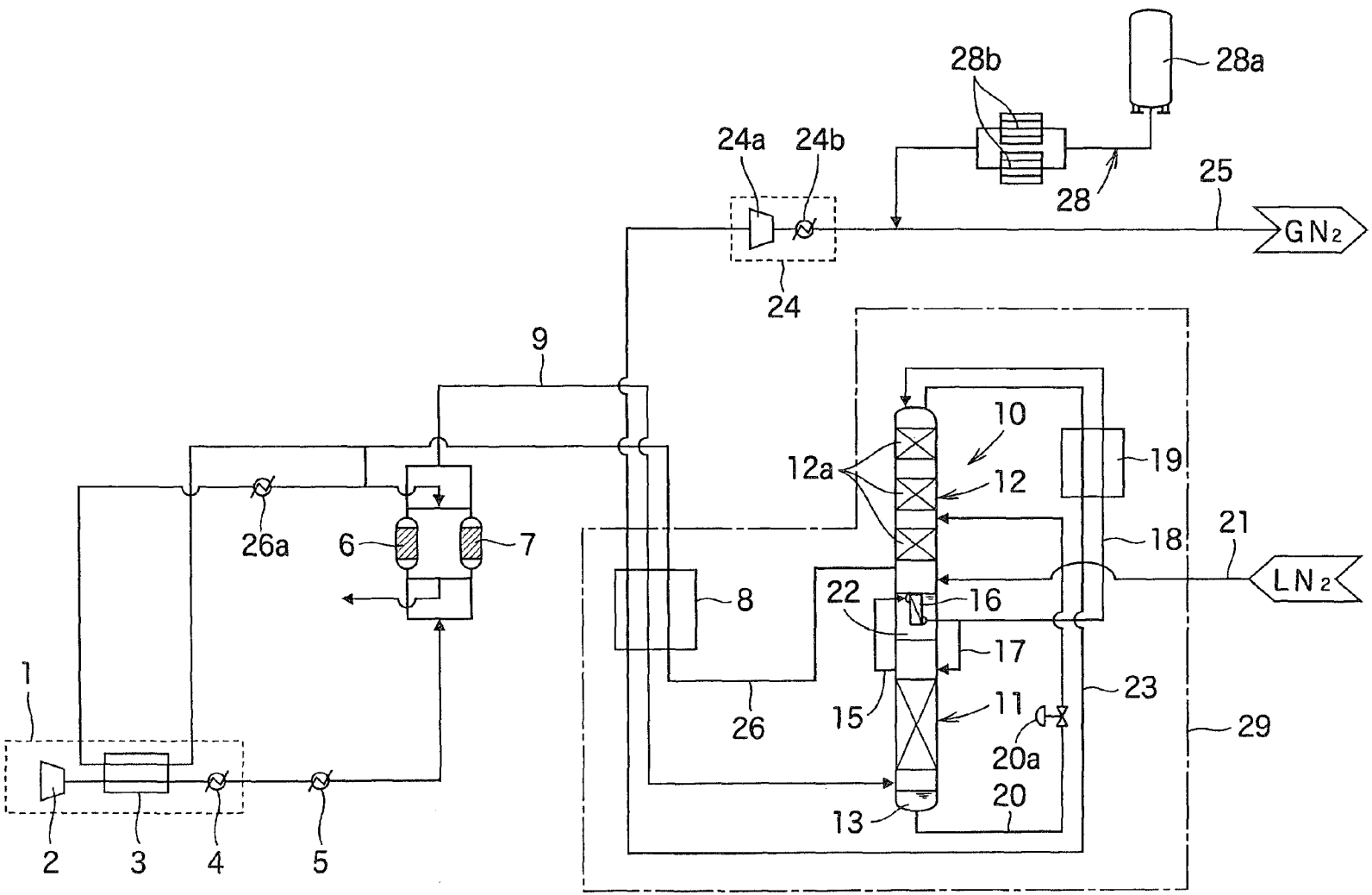
FIG. 1 is a diagram showing a preferred embodiment of a nitrogen generating apparatus according to the present invention.

11 high-pressure column
12 low-pressure column

12*a* rectification part
13 liquid air
16 condenser
20 extraction pipe
22 oxygen-enriched liquid air

BEST MODE FOR CARRYING OUT THE INVENTION

Next, a preferred embodiment according to the present invention will now be described in detail, with reference to the drawings.

FIG. 1 shows a preferred embodiment of a nitrogen generating apparatus according to the present invention. In FIG. 1, the reference numeral 1 designates a raw material air compression apparatus which includes a raw material air compressor 2 for compressing air taken from outside (to a pressure of approximately 0.47 MPaG), a heat exchanger 3 for heat-exchanging an exhaust gas taken out of a low-pressure column 12 to be described later and the compressed air which is compressed in the raw material air compressor 2 to heat the exhaust gas up to an increased temperature and to cool the compressed air down to a decreased temperature, and a drain separator 4. The reference numeral 5 designates a cooler for cooling down the compressed air passed through the above-mentioned raw material air compression apparatus 1 by using cooling water, and 6 and 7 designate air pretreatment apparatuses including a pair of adsorption columns for adsorptively removing moisture and carbon dioxide from the compressed air passed through the above-mentioned cooler 5. The reference numeral 8 designates a main heat exchanger of a plate-fin type. The compressed air passed through the above-mentioned adsorption columns 6 and 7 through a compressed air supply pipe 9 is fed into the main heat exchanger 8. The main heat exchanger 8 cools the compressed air down to an ultra low temperature (approximately −175° C.). by the heat exchange action with a high purity nitrogen gas, and an exhaust gas to be described later.

The reference numeral 10 designates a rectification column of a double rectification type which includes a high-pressure column 11 (driven at a pressure of approximately 0.45 MPaG), and the low-pressure column 12 (driven at a pressure of approximately 0.04 MPaG) provided over the high-pressure column 11. In the above-mentioned high-pressure column 11, the compressed air cooled by the main heat exchanger 8 and fed into a lower portion of the high-pressure column 11 is further cooled down and cryogenically separated by the use of a difference in boiling point between components in the compressed air, whereby a high boiling point component (oxygen) in the compressed air is liquefied and stored as liquid air 13 (having an oxygen concentration of approximately 35% by volume) in a bottom portion of the high-pressure column 11 whereas nitrogen as a low boiling point component is taken in gaseous form from a top portion of the high-pressure column 11.

The reference numeral 15 designates a first reflux pipe for feeding the high purity nitrogen gas taken from the top portion of the above-mentioned high-pressure column 11 into a condenser 16 to be described below. The high purity nitrogen gas fed by the first reflux pipe 15 into the condenser 16 is liquefied by the condenser 16. Part of the high purity liquid nitrogen is refluxed as a reflux liquid through a second reflux pipe 17 to the top portion of the above-mentioned high-pressure column 11, whereas the remainder of the high purity liquid nitrogen is introduced through a supply pipe 18 into a super-cooler 19, is cooled down by the heat exchange with the high purity nitrogen gas, and is then supplied to the top portion of the above-mentioned low-pressure column 12.

The reference numeral 20 designates an extraction pipe (liquid air extraction passage) with an expansion valve 20*a* for feeding the liquid air 13 stored in the bottom portion of the above-mentioned high-pressure column 11 to rectification tray parts (rectification parts) 12*a* of the low-pressure column 12. In this preferred embodiment, the above-mentioned liquid air 13 is fed to between the lowest rectification tray and the tenth lowest rectification tray (both not shown) in the rectification parts 12*a* of the low-pressure column 12. The reference numeral 21 designates a liquid nitrogen inlet pipe for feeding liquid nitrogen from a liquid nitrogen tank (not shown) (supplied with liquid nitrogen from the outside of the apparatus) into a lower portion of the rectification tray parts 12*a* of the low-pressure column 12. In the low-pressure column 12, the liquid air 13 in a gas-liquid mixed state fed through the extraction pipe 20 is further cooled down and cryogenically separated by the use of a difference in boiling point between components in the liquid air 13, whereby a high boiling point component (oxygen) in the liquid air 13 is liquefied and stored as oxygen-enriched liquid air 22 (having an oxygen concentration of approximately 90% by volume) in a bottom portion of the low-pressure column 12 whereas nitrogen as a low boiling point component is taken in gaseous form from a top portion of the low-pressure column 12, as in the high-pressure column 11. The high purity nitrogen gas taken from the top portion of the low-pressure column 12 (having a nitrogen concentration of approximately 100% by volume, which is approximately equal to the nitrogen concentration of the high purity nitrogen gas taken from the top portion of the high-pressure column 11) is obtained by feeding the liquid air 13 stored in the bottom portion of the high-pressure column 11 into the low-pressure column 12 and cryogenically separating the liquid air 13 again. The amount of nitrogen gas thus obtained is much greater than the amount of nitrogen gas obtained from a nitrogen generating apparatus of a single rectification type.

The condenser 16 is immersed in the oxygen-enriched liquid air 22 stored in the bottom portion of the above-mentioned low-pressure column 12. As described above, the condenser 16 liquefies the high purity nitrogen gas taken from the top portion of the above-mentioned high-pressure column 11, and evaporates the oxygen-enriched liquid air 22 around the condenser 16 by heating to generate an ascending gas within the low-pressure column 12. The ascending gas, the high purity liquid nitrogen flowing down from the top portion of the low-pressure column 12 and the liquid air 13 supplied to the rectification parts 12*a* of the low-pressure column 12 are rectified by coming into contact with each other, whereby the oxygen-enriched liquid air 22 is stored in the bottom portion whereas the high purity nitrogen gas is taken from the top portion, as discussed above.

The reference numeral 23 designates an extraction pipe for extracting the high purity nitrogen gas from the top portion of the above-mentioned low-pressure column 12. The high purity nitrogen gas is heated up to room temperature by passing the high purity nitrogen gas through the super-cooler 19 and the main heat exchanger 8. After a nitrogen compressor 24*a* in a nitrogen compression apparatus 24 compresses the high purity nitrogen gas to a predetermined pressure, the compressed high purity nitrogen gas is introduced into a product nitrogen gas extraction pipe (product gas extraction passage) 25, and is supplied as a product nitrogen gas to a customer site. The reference numeral 26 designates an exhaust gas extraction pipe extending from the lower portion of the rectification parts 12*a* of the above-mentioned low-pressure column 12 (that is, a portion below a liquid air inlet at which the liquid air from the extraction pipe 20 enters the rectification parts 12*a*). The exhaust gas extraction pipe 26 serves to extract an exhaust gas (having an oxygen concentration of approximately 80% by volume) generated by the evaporation of the oxygen-enriched liquid air 22 in the bottom portion of the above-mentioned low-pressure column 12. This exhaust gas is introduced by the exhaust gas extraction pipe 26 into the main heat exchanger 8 and is heated therein up to room temperature. After the heated exhaust gas is further heated in the heat exchanger 3, the heated exhaust gas is used as a regenerating gas for the adsorption columns 6 and 7, and is released to the atmosphere. In FIG. 1, the reference character 24*b* designates a cooler in the nitrogen compression apparatus 24.

The reference numeral 28 designates a backup system line in which backup liquid nitrogen evaporators 28*b* evaporate liquid nitrogen within a backup liquid nitrogen tank 28*a* to feed the nitrogen gas into the product nitrogen gas extraction pipe 25, thereby avoiding the interruption of the supply of nitrogen gas when the present apparatus fails or there arises a shortage of the product nitrogen gas. In FIG. 1, the reference numeral 29 designates a cold box for vacuum insulating the interior thereof.

This nitrogen generating apparatus produces a product nitrogen gas in a manner to be described below. First, the raw material air compressor 2 takes air from outside thereinto to compress the air. The compressed air is passed through the heat exchanger 3, the drain separator 4 and the cooler 5 so that moisture is removed from the compressed air and the compressed air is cooled down. Thereafter, the compressed air is fed into the adsorption column 6 (7) so that moisture and carbon dioxide are adsorptively removed from the compressed air. Next, the compressed air from which moisture and carbon dioxide are adsorptively removed is fed through the compressed air supply pipe 9 into the main heat exchanger 8, and is cooled down to an ultra low temperature in the main heat exchanger 8. The cooled compressed air is introduced into the lower portion of the high-pressure column 11. Next, the introduced compressed air is cooled down by bringing the compressed air into countercurrent contact with the reflux liquid passed through the condenser 16 back to the top portion of the high-pressure column 11. Part of the cooled air is liquefied and stored as the liquid air 13 in the bottom portion of the high-pressure column 11. The liquid air 13 is fed through the extraction pipe 20 with the expansion valve 20*a* into the low-pressure column 12 to cool down the condenser 16. This cooling liquefies the high purity nitrogen gas fed from the top portion of the high-pressure column 11 into the condenser 16. Part of this high purity liquid nitrogen becomes the reflux liquid which in turn passes through the second reflux pipe 17 back to the top portion of the high-pressure column 11, whereas the remainder of the high purity liquid nitrogen passes through the supply pipe 18, is cooled down by the super-cooler 19, and is supplied to the top portion of the above-mentioned low-pressure column 12. In the course of cooling by contacting the introduced compressed air and the reflux liquid within the high-pressure column 11 as described above, oxygen serving as the high boiling point component in the compressed air is liquefied and flows down and the nitrogen remains in gaseous form in the top portion of the high-pressure column 11 and is fed through the first reflux pipe 15 into the condenser 16 because of the difference in boiling point between nitrogen and oxygen.

On the other hand, the liquid nitrogen serving as a cooling source is fed from the liquid nitrogen tank through the liquid nitrogen inlet pipe 21 into the low-pressure column 12. The ascending gas generated from the oxygen-enriched liquid air 22 within the low-pressure column 12 is cooled by bringing the ascending gas into countercurrent contact with the high purity liquid nitrogen supplied from the condenser 16 to the top portion of the low-pressure column 12 and the liquid air 13 introduced into the low-pressure column 12. In the course of this cooling, oxygen serving as the high boiling point component in the compressed air is liquefied, flows down and is stored as the oxygen-enriched liquid air 22 in the bottom portion of the low-pressure column 12 to cool down the condenser 16, and the nitrogen in gaseous form is taken from the top portion of the high-pressure column 11 through the extraction pipe 23 into the super-cooler 19 and the main heat exchanger 8, heated up to near room temperature and is fed out as the product nitrogen gas because of the difference in boiling point between nitrogen and oxygen. The exhaust gas in the bottom portion of the above-mentioned low-pressure column 12 is taken out by the exhaust gas extraction pipe 26, is used as the regenerating gas for the adsorption columns 6 and 7, and is released to the atmosphere.

As described above, this preferred embodiment uses the rectification column 10 of the double rectification type to feed the liquid air 13 stored in the bottom portion of the high-pressure column 11 into the low-pressure column 12, thereby cryogenically separating the liquid air 13 again. Thus, the yield of the high purity nitrogen gas is significantly improved (improved up to an A/N ratio approximately equal to 1.4). This significantly reduces the amount of raw material air to reduce the size of the facilities related to the raw material air (the raw material air compressor 2, the pair of adsorption columns 6 and 7, their incidental piping facilities and the like), thereby reducing power consumption and costs of facilities. Additionally, this preferred embodiment significantly reduces the amount of coolant (the amount of injection of the liquid nitrogen) which supplements the heat loss in the main heat exchanger 8, and utilizes the cooling energy of the liquid nitrogen injected into the low-pressure column 12 even in a low-pressure region to further reduce the amount of injection of the liquid nitrogen. Further, this preferred embodiment reduces the size of the cold box 29 to decrease the heat leak from the cold box 29, thereby accomplishing the further reduction in the amount of injection of the liquid nitrogen. In this preferred embodiment, the amount of injection of the liquid nitrogen can be reduced to approximately 0.5% of the amount of product nitrogen.

Figure 2:
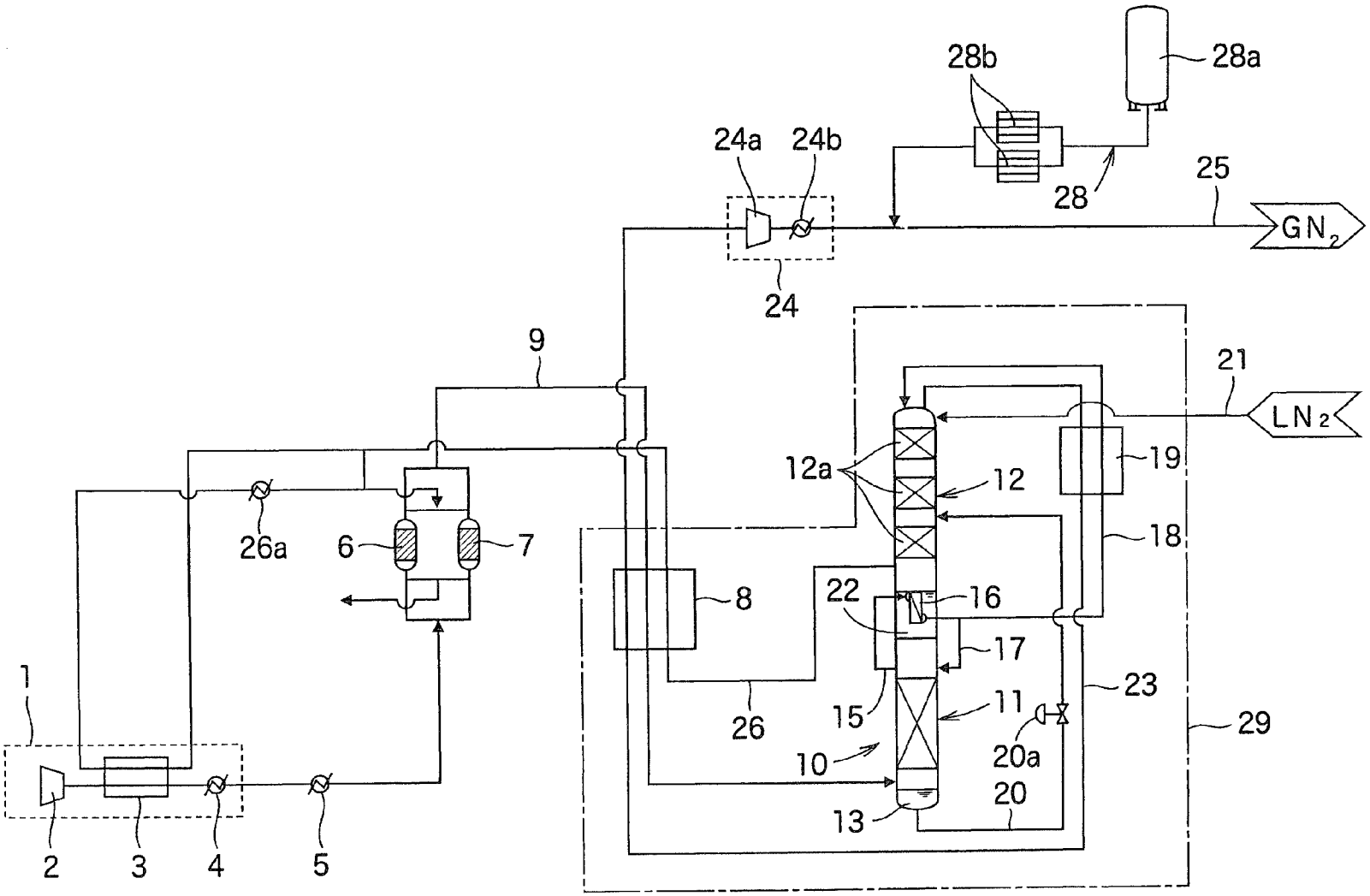
FIG. 2 is a diagram showing another preferred embodiment of the nitrogen generating apparatus according to the present invention.
Figure 3:
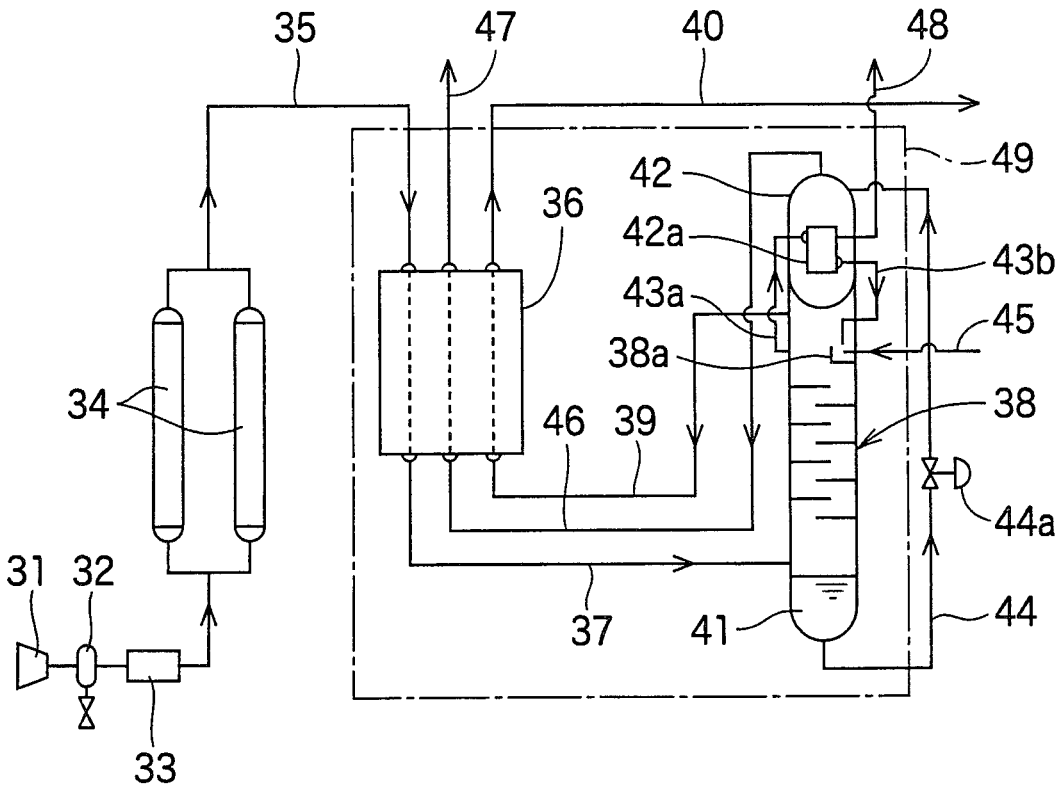
Fig. 3 PRIOR ART
FIG. 3 is a diagram showing a conventional apparatus.

FIG. 2 shows a second preferred embodiment of the nitrogen generating apparatus according to the present invention. The second preferred embodiment is adapted to feed liquid nitrogen as a cooling source from the liquid nitrogen tank to the top portion of the low-pressure column 12 in the first preferred embodiment described above. Other parts of the second preferred embodiment are similar to those of the first preferred embodiment, and like reference numerals and characters are used to designate similar parts. The second preferred embodiment produces functions and effects similar to those of the first preferred embodiment described above.

The first and second preferred embodiments described above use the rectification tray parts as the rectification parts 12*a* of the above-mentioned high-pressure column 11 (that is, the rectification is carried out by rectification trays). The present invention, however, is not limited to this. The rectification may be carried out by using various packings such as a structured packing, a random packing and the like. In this case, the liquid air 13 to be stored in the bottom portion of the above-mentioned high-pressure column 11 is introduced into a portion of the packing having a height corresponding to the first to tenth theoretical plates in the rectification parts 12*a* which accommodate the packing. The liquid nitrogen is introduced into the lower portion of the rectification parts 12*a* of the low-pressure column 12 or the upper portion of the rectification parts 12*a* such as the top portion in the first and second preferred embodiments described above, but may be introduced into any portion (including the rectification parts 12*a*) of the low-pressure column 12 or into any portion of the high-pressure column 11. The liquid nitrogen is introduced into the low-pressure column 12 as the cooling source in the first and second preferred embodiments described above. However, liquid air may be introduced in place of the liquid nitrogen.

Industrial Applicability

The present invention significantly improves the yield of the high purity nitrogen gas to significantly reduce the amount of raw material air, thereby accomplishing significant reductions in power consumption, the amount of coolant and the costs of facilities.

The invention claimed is:

1. A method of generating nitrogen comprising:

compressing air taken from outside by using an air compression means;

after introducing the compressed air into an adsorption column to adsorptively remove moisture and carbon dioxide, cooling the compressed air down to a low temperature in a main heat exchanger and then introducing the compressed air into a high-pressure column;

cryogenically separating the compressed air introduced into the high-pressure column by using a difference in boiling point between components in the compressed air;

storing liquid air in a bottom portion of the high-pressure column and taking nitrogen in gaseous form for use as a reflux liquid from an upper portion of the high-pressure column;

introducing the liquid air stored in the bottom portion of the high-pressure column through a liquid air extraction passage into a low-pressure column;

cryogenically separating the liquid air introduced into the low-pressure column by using a difference in boiling point between components in the liquid air;

storing oxygen-enriched liquid air in a bottom portion of the low-pressure column and taking nitrogen in gaseous form from an upper portion of the low-pressure column; after compressing the nitrogen in gaseous form from the low pressure column to a predetermined pressure by a nitrogen compressor, introducing the compressed nitrogen from the low-pressure column as a product gas into a product gas extraction passage and supplying the compressed nitrogen to outside;

introducing the nitrogen in gaseous form extracted for use as the reflux liquid from the upper portion of the high-pressure column into a condenser to liquefy the nitrogen from the high-pressure column;

refluxing part of the liquid nitrogen as the reflux liquid to the high-pressure column and feeding the remainder of the liquid nitrogen to the upper portion of the low-pressure column; and introducing liquid nitrogen or liquid oxygen from outside a system into the low-pressure column as a coolant for supplementing heat loss in the heat exchanger or heat entering from outside, wherein the liquid air in a bottom portion of the high-pressure column taken through the liquid air extraction passage is introduced into a portion of a rectification part of the low-pressure column having a number of theoretical plates from a column bottom side within the range of one to ten;

oxygen-enriched air in gaseous form is taken from an exhaust gas outlet provided at only one part below the rectification part of the low-pressure column and above the condenser;

the oxygen-enriched air is introduced into the main heat exchanger to cool the compressed air and then introduced into a heat exchanger of the air compression means and the adsorption column; and after being used as a cold source for the air compression means and as a regenerating gas for the adsorption column, the oxygen-enriched air is released to the atmosphere;

wherein a portion of product gas compressed with the nitrogen compressor is introduced into and stored in a backup liquid nitrogen tank attached directly to the product gas extraction passage at downstream of the nitrogen compressor by using the pressure of the product gas; and wherein when the product gas is in short supply, liquid nitrogen within the backup liquid nitrogen tank is introduced, by using a pressure within the backup liquid nitrogen tank, into a backup liquid nitrogen evaporator for evaporation, and the evaporated nitrogen is fed into the product gas extraction passage depending on reduction of gas pressure at the product gas extraction passage which is caused by a shortage of the product gas.

2. An apparatus for generating nitrogen comprising: an air compression means for compressing air taken from outside; an adsorption column for adsorptively removing moisture and carbon dioxide from the compressed air compressed by the air compression means; a main heat exchanger for cooling the compressed air passed through the adsorption column down to a low temperature; a high-pressure column for cryogenically separating the compressed air cooled down to the low temperature through the main heat exchanger by using a difference in boiling point between components in the compressed air to store liquid air in a bottom portion of the high-pressure column and to take nitrogen in gaseous form for use as a reflux liquid from an upper portion of the high-pressure column; a low-pressure column receiving the liquid air taken from the bottom portion of the high-pressure column through a liquid air extraction passage and for cryogenically separating the liquid air by using a difference in boiling point between components in the liquid air to store oxygen-enriched liquid air in a bottom portion of the low-pressure column and to take nitrogen in gaseous form from an upper portion of the low-pressure column; a nitrogen compressor for compressing the nitrogen taken in gaseous form from the upper portion of the low-pressure column;

a product gas extraction passage for supplying the compressed nitrogen to outside as a product gas;

a condenser receiving the nitrogen in gaseous form extracted for use as the reflux liquid from the upper portion of the high-pressure column and for liquefying the nitrogen from the high-pressure column;

a reflux passage for refluxing part of the liquid nitrogen taken from the condenser as the reflux liquid to the high-pressure column;

a feed passage for feeding the remainder of the liquid nitrogen taken from the condenser to the upper portion of the low-pressure column; and an inlet passage for introducing liquid nitrogen or liquid oxygen from outside a system into the low-pressure column as a coolant for supplementing heat loss in the heat exchanger or heat entering from outside, wherein the liquid air in a bottom portion of the high-pressure column taken through the liquid air extraction passage is introduced into a portion of a rectification part of the low-pressure column having a number of theoretical plates from a column bottom side within the range of one to ten;

oxygen-enriched air in gaseous form is taken from an exhaust gas outlet provided at only one part below the rectification part of the low-pressure column and above the condenser;

the oxygen-enriched air is introduced into the main heat exchanger to cool the compressed air and then introduced into a heat exchanger of the air compression means and the adsorption column; and after being used as a cold source for the air compression means and as a regenerating gas for the adsorption column, the oxygen-enriched air is released to the atmosphere; and wherein a backup liquid nitrogen tank and a backup liquid nitrogen evaporator are attached directly to the product gas extraction passage downstream of the nitrogen compressor; a portion of product gas flowing within the product gas extraction passage is introduced into and stored in the backup liquid nitrogen tank by using the pressure of the product gas; and liquid nitrogen within the backup liquid nitrogen tank is introduced into the product gas extraction passage through the backup liquid nitrogen evaporator depending on reduction of gas pressure at the product gas extraction passage, which is caused by a failure of the present apparatus or a shortage of the product gas, when the product gas is in short supply.

3. The apparatus according to claim 2, wherein an inlet of the inlet passage is provided in a lower portion of the rectification part of the low-pressure column.

* * * * *